United States Patent [19]

Datis

[11] 4,087,228

[45] May 2, 1978

[54] GASOLINE STATION EMISSIONS CONTROL

[75] Inventor: Angelo P. Datis, Los Angeles, Calif.

[73] Assignee: Process Products, Inc., Gardena, Calif.

[21] Appl. No.: 704,242

[22] Filed: Jul. 12, 1976

[51] Int. Cl.[2] ..... F23G 7/06

[52] U.S. Cl. ..... 431/5; 23/277 C; 110/210; 431/202; 431/346

[58] Field of Search ..... 431/5, 202, 90, 12, 431/346; 23/277 C; 110/8 A

[56] References Cited

U.S. PATENT DOCUMENTS

| | | | |
|---|---|---|---|
| 3,817,687 | 6/1974 | Cavallero | 431/202 |
| 3,837,785 | 9/1974 | Evans et al. | 431/5 |
| 3,837,813 | 9/1974 | Ebeling et al. | 23/277 C |
| 3,917,796 | 11/1975 | Ebeling | 431/5 X |
| 3,999,936 | 12/1976 | Hasselmann | 431/202 |
| 4,009,985 | 3/1977 | Hirt | 431/5 |

*Primary Examiner*—Edward G. Favors
*Attorney, Agent, or Firm*—Lyon & Lyon

[57] ABSTRACT

A method and apparatus for preventing the discharge of gasoline dispensing station hydrocarbon vapors into the atmosphere comprising an incinerator which is utilized to burn a mixture of the hydrocarbon vapors and air supplied by an air compressor. Control means are provided to insure that the velocity of the hydrocarbon vapors supplied to the incinerator is at least 10 feet per second and the pressure of the air entering the incinerator is at least 3 inches of water above atmospheric pressure.

2 Claims, 1 Drawing Figure

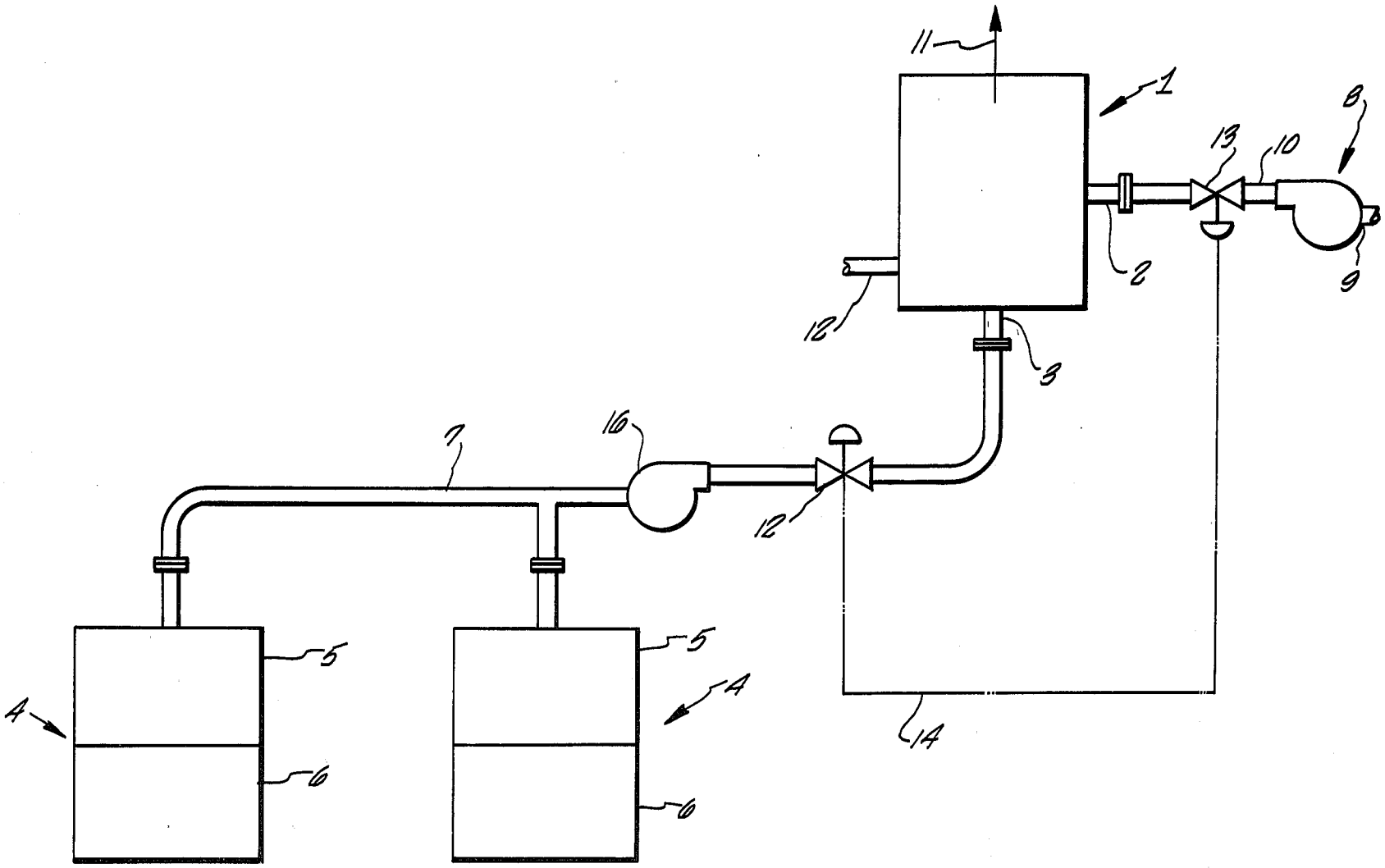
8
9
10
13
1
2
3
11
14
15
12
16
4
5
6
7
5
6
4

GASOLINE STATION EMISSIONS CONTROL

BACKGROUND OF THE INVENTION

1. Field of the Invention

The present invention is directed to a method and apparatus for preventing the discharge of gasoline dispensing station hydrocarbon vapors into the atmosphere.

2. Description of the Prior Art

Until recently, gasoline vapors produced at gasoline dispensing stations were allowed to be discharged into the atmosphere with attendant air pollution problems. Indeed, at the present time, most gasoline dispensing stations are without adequate means to prevent such hydrocarbon vapor discharge to the atmosphere. Recently, various attempts have been made to prevent the discharge of such vapors to the atmosphere including elaborate systems to refrigerate and condense the hydrocarbon vapors, and numerous cataysts used to absorb the vapors.

SUMMARY OF THE INVENTION

A method and apparatus for preventing the discharge of gasoline dispensing station hydrocarbon vapors into the atmosphere comprising an incinerator which is utilized to burn a mixture of the hydrocarbon vapors and air supplied by an air compressor. Control means are provided to insure that the velocity of the hydrocarbon vapors supplied to the incinerator is at least 10 feet per second and the pressure of the air entering the incinerator is at least 3 inches of water above atmospheric pressure. Hydrocarbon vapor flow control means and air flow control means are provided in order to stop the flow of air and hydrocarbon vapor to the incinerator when either the hydrocarbon vapor velocity or the air pressure decrease below 10 feet per second and 3 inches of water above atmospheric pressure respectively.

BRIEF DESCRIPTION OF THE DRAWING

FIG. 1 is a schematic view of the invention.

DESCRIPTION OF SPECIFIC EMBODIMENTS

As shown in the figure, at least one hydrocarbon storage tank 4 is provided having a hydrocarbon vapor space 5 and a hydrocarbon liquid space 6. The storage tank 4 may be a vehicle hydrocarbon storage tank or a permanent storage tank located at the service station. The hydrocarbon storage tanks are connected to an inlet 3 of an incinerator 1 by means of a conduit 7.

An air pump or compressor 8 is provided having an inlet open to the atmosphere and an outlet 10 which is connected to the air inlet 2 in the incinerator 1. The incinerator 1 is further provided with a suitable ignitor or ignition system 12 located adjacent the hydrocarbon vapor inlet 3 and the air inlet 2. The incinerator 1 is further provided with an outlet which may be in the form of a stack 11.

The hydrocarbon vapor conduit 7 may be provided with a flow control device 12 which monitors the flow of hydrocarbon vapors to the incinerator and stops the flow of hydrocarbon vapor and air to the incinerator when the velocity of hydrocarbon vapors to the incinerator decreases below a velocity of 10 feet per second. Further, a hydrocarbon blower 16 may be provided between the outlet of the storage tank 4 and the flow control device 12 in order to insure that such a hydrocarbon velocity may be realized. Similarly, a flow control device 13 may be positioned adjacent the air inlet 2 of the incinerator 1 in order to measure the incoming air pressure. Flow control means 13 is adapted to stop the flow fo hydrocarbon vapor and air to the incinerator 11 when the air pressure decreases to a level below 3 inches of water above atmospheric pressure. The flow control devices 12 and 13 are interconnected by appropriate circuitry which may be hydraulic, pneumatic or electrical as indicated by the connection 14.

Such an incinerator system provides for a vastly simplified method preventing the discharge of hydrocarbon vapors into the atmosphere while maintaining a safe operation. The monitoring of the hydrocarbon vapor velocity and air pressure insures that there will be adequate flame propagation rates within the incinerator and there is no possibility of damage due to the gasoline station emission control system.

What is claimed is:

1. A gasoline dispensing station hydrocarbon vapor incineration device comprising:

at least one hydrocarbon storage tank, said tank having a hydrocarbon liquid space and a hydrocarbon vapor space;

an air compressor having an inlet and an outlet;

an incinerator having an outlet, an air inlet and a hydrocarbon vapor inlet;

a conduit connecting said hydrocarbon storage tank, hydrocarbon vapor space and said incinerator hydrocarbon vapor inlet;

a conduit connecting said air compressor outlet and said incinerator air inlet;

incinerator ignition means positioned adjacent said incinerator air inlet and hydrocarbon vapor inlet for burning said air and hydrocarbon vapor;

hydrocarbon vapor flow control means located in said conduit connecting said pressurized tank hydrocarbon vapor space and said incinerator for stopping the flow of air and hydrocarbon vapor to said incinerator when the velocity of the hydrocarbon vapors falls below a predetermined level;

hydrocarbon vapor blower means for purifying said hydrocarbon vapors located between said hydrocarbon storage tank and said hydrocarbon vapor flow control means; and air flow control means located in said conduit connecting said air compressor outlet and said incinerator for stopping the flow of air and hydrocarbon vapor to said incinerator when the air pressure at the inlet to said incinerator falls below a predetermined level.

2. A method of preventing the discharge of gasoline dispensing station hydrocarbon vapors into the atmosphere comprising:

passing hydrocarbon vapors from a hydrocarbon storage tank into an incinerator at a velocity of at least ten feet per second;

pumping air into said incinerator at a pressure of at least three inches of water above atmospheric pressure; and burning said air and hydrocarbon vapor.

* * * * *